United States Patent [19]

Buck et al.

[11] Patent Number: 4,861,945

[45] Date of Patent: Aug. 29, 1989

[54] YIELDABLY EXTENSIBLE SELF-RETRACTING SHIELDED CABLE

[75] Inventors: Arthur G. Buck, Sherwood; Ronald A. Olson, Portland; Doris A. Beck, Beaverton, all of Oreg.

[73] Assignee: Precision Interconnect Corporation, Portland, Oreg.

[21] Appl. No.: 281,741

[22] Filed: Dec. 9, 1988

[51] Int. Cl.[4] ..... H01B 7/06; H01P 3/06

[52] U.S. Cl. ..... 174/69; 174/106 R; 174/107; 174/108; 333/243

[58] Field of Search ..... 174/36, 69, 106 R, 107, 174/108, 110 PM, 110 FC, 110 F; 333/243

[56] References Cited

U.S. PATENT DOCUMENTS

| | | | |
|---|---|---|---|
| 3,240,867 | 3/1966 | Maddox | 174/69 |
| 3,274,329 | 9/1966 | Timmons | 174/69 |
| 3,334,177 | 8/1967 | Martin | 174/108 X |
| 4,131,757 | 12/1978 | Felkel | 174/108 X |
| 4,408,089 | 10/1983 | Nixon | 174/108 X |
| 4,552,989 | 11/1985 | Sass | 174/108 X |
| 4,638,114 | 1/1987 | Mori | 174/108 X |
| 4,738,734 | 4/1988 | Ziemek | 174/108 X |

FOREIGN PATENT DOCUMENTS 2116364 10/1972 Fed. Rep. of Germany ..... 174/108

*Primary Examiner*—Laramie E. Askin

*Attorney, Agent, or Firm*—Chernoff, Vilhauer, McClung & Stenzel

[57] ABSTRACT

A yieldably extensible, self-retracting cable comprises a flexible center conductor surrounded by a primary dielectric material with a flexible wire shield exterior thereof and a thermoplastic or thermosetting elastomeric outer jacket formed permanently in a helical shape. The primary dielectric insulation comprises materials such as polymeric fluorocarbon or irradiated polyethylene having an exceptionally low dielectric constant. The low dielectric constant is maintained despite the permanently coiled configuration of the cable by ensuring that the plasticizing or curing temperature of the jacket is less than the melting or other degradation temperature of the dielectric material, and by utilizing unbraided wire shielding comprising a pair of concentric layers of wire wound helically in mutually-opposite directions to avoid mechanical injury of the dielectric material.

5 Claims, 1 Drawing Sheet

YIELDABLY EXTENSIBLE SELF-RETRACTING SHIELDED CABLE

BACKGROUND OF THE INVENTION

The present invention relates to yieldably extensible, self-retracting shielded cables, and particularly to such cables which are capable of carrying high frequency signals.

Yieldably extensible, self-retracting shielded cables have been known in the past as evidenced, for example, by the constructions shown in Maddox U.S. Pat. No. 3,240,867 and Timmons U.S. Pat. No. 3,274,329. Such previous cables employ exterior heat-settable dielectric jackets, i.e., either thermoplastic jackets which are heated to their plasticizing temperatures and cooled or thermosetting jackets which are heated to their curing temperatures, while held in a coiled configuration in order to form the permanently-coiled shape which provides the desired yieldable retractability. The primary electrical insulation between the central conductors and shields of such previous self-retracting cables is normally rubber or plastic having a high enough melting point (or other degradation point) that the location of the central conductor relative to the shield, and the electrical properties of the insulation, are not changed by the heating of the exterior jacket to its plasticizing or curing temperature as the case may be. Such insulation also has sufficient mechanical strength that the electrical properties of such insulation are not significantly affected by the kinking and distortion of a surrounding braided wire shield caused by the coiled configuration. Unfortunately, such insulation materials which are thermally and mechanically resistant to the jacket heating procedure and to the kinking of the shield have a relatively high dielectric constant unsuitable for transmission of high frequency signals.

Alternative electrical insulation materials having substantially lower dielectric constants suitable for the transmission of high-frequency signals have been available for some time. These are primarily expanded, stretched or foamed materials, such as polymeric fluorocarbon, which are relatively porous in order to produce a low dielectric constant but which, as a result of their porosity, do not have as high mechanical strengths as those insulating materials of higher density and higher dielectric constant. Although these low-dielectric-constant insulating materials have been used successfully in straight shielded cables as exemplified by Sass U.S. Pat. No. 4,552,989, they have not successfully been employed in permanently coiled, yieldably extensible and retractable cables for two significant reasons: first, some of them have relatively low melting points (or other degradation points) so that subjecting them to the plasticizing or curing temperature of the exterior jacket would degrade their electrical characteristics and/or change the location of the conductor or conductors relative to the shield; second, their relatively fragile mechanical properties cause their electrical characteristics likewise to be adversely affected if subjected to kinking or distortion of a surrounding braided wire shield having a coiled configuration.

Unbraided helical shields wrapped in a single direction as shown, for example, in Timmons U.S. Pat. No. 3,274,329, while being less likely to kink or distort and thus less likely to affect the more fragile insulating materials, cause excessive inductance in the shield and thus distort high-frequency transmissions. Although wire shields composed of inner and outer layers of unbraided wire helically wound in opposite directions have also been employed in the past, as exemplified by Martin U.S. Pat. No. 3,334,177, Felkel U.S. Pat. No. 4,131,757 and Ziemek U.S. Pat. No. 4,738,734, they have not been employed advantageously in permanently coiled, extensible and retractable cables.

Accordingly, what is needed is a cable construction which renders the use of low-dielectric-constant insulating materials, for high-frequency signal transmissions, compatible with a permanently-coiled extensible and retractable cable configuration having a shield likewise suitable for high-frequency transmissions.

SUMMARY OF THE INVENTION

The present invention achieves the desired compatibility, between low-dielectric-constant insulation on one hand and permanently-coiled cable configurations with high-frequency shields on the other, by utilizing a multilayer, oppositely-wound, unbraided wire shield configuration in combination with a low-dielectric-constant insulating material having a melting or other degradation temperature higher than the plasticizing or curing temperature (hereafter collectively referred to as "setting temperature") of a heat-settable thermoplastic or thermosetting cable jacket. The oppositely-wound, unbraided shield not only is relatively immune to kinking and distortion from the coiled configuration, thus adversely affecting neither its own electrical characteristics nor those of the underlying insulating material, but also is relatively free of inductance which would otherwise distort high-frequency signals. Cooperatively, the selection of low-dielectric-constant materials, such as polymeric fluorocarbon (e.g., PTFE), or irradiated polyethylene or mixtures thereof, having a higher melting point or other degradation temperature than the setting temperature of the thermoplastic or thermosetting jacket, protects the insulation from adverse thermal effects of the jacket heating procedure which would otherwise adversely affect its electrical properties, while the insulation is simultaneously protected from adverse mechanical effects of the shield and the coiled configuration.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 2:
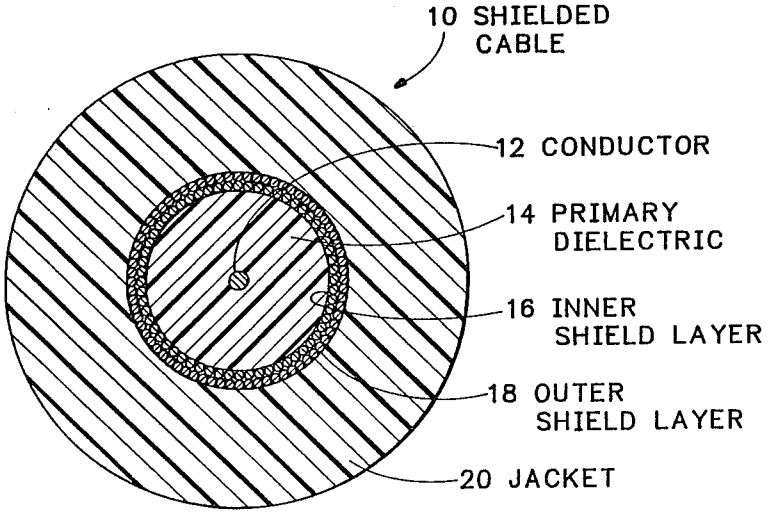
FIG. 2 is an enlarged cross-sectional view taken along line 2—2 of FIG. 1.
Figure 1:
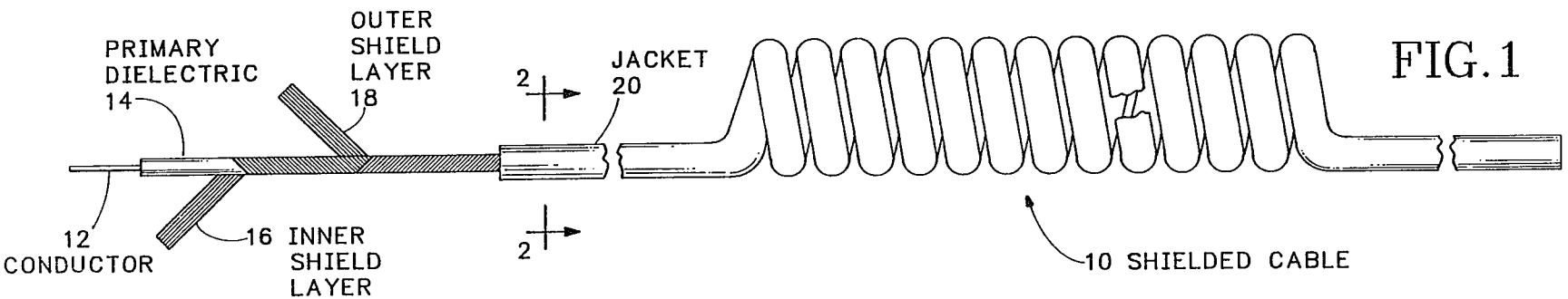
FIG. 1 is an extended side view of an exemplary embodiment of a permanently coiled, shielded cable in accordance with the present invention.

FIGS. 1 and 2 show an exemplary permanently-coiled, yieldably extensible and retractable coaxial cable constructed in accordance with the present invention and usable for such purposes as interconnecting an electrical probe with an oscilloscope. Configurations other than a simple single coaxial structure are also intended to be within the scope of the invention.

The shielded cable 10 comprises an inner flexible electrical conductor 12 surrounded by a flexible primary dielectric material 14 which may be a polymeric fluorocarbon such as PTFE in expanded, low-density form, such as stretched tape or extruded foam, such material having a relatively high melting point (e.g., approximately 327° C. for PTFE). Other substances appropriate for the primary dielectric material 14 include irradiated polyethylene. Also, mixtures of these two materials can be used.

Surrounding the primary dielectric material 14 is a flexible wire shield (or conductor) comprising at least a pair of concentric layers of electrically conductive wire 16 and 18, respectively, the two layers being wound helically in mutually-opposite directions one around the other as best shown in FIG. 1. Preferably, in order to minimize the inductance of the shield, the two layers 16 and 18 should have substantially the same current-carrying capacities (i.e. substantially the same total conductive cross sections). A braided shield is avoided in accordance with the present invention because of its tendency to kink and distort when placed in a coiled, extensible and retractable configuration.

The outer jacket 20 is of either a thermoplastic material such as polyvinyl chloride or polyurethane, or a thermosetting material such as silicone rubber or polymerized chloroprene (e.g. Neoprene TM ). By heating it to its setting temperature (e.g. 121° C. for polyvinyl chloride or polyurethane) while in a coiled helical configuration, the jacket can be permanently formed in an elastomeric helical configuration as shown in FIG. 1 which is yieldably extensible and retractable.

Formation of the helical configuration, for example, can be accomplished by winding the straight cable helically around a rod and heating the wound cable to the setting temperature of the jacket so that it permanently forms the desired helical shape, followed by cooling the wound cable. The primary dielectric material 14, having a higher melting or other degradation temperature than the setting temperature of the jacket 20, is unaffected by the heating and its dielectric constant and the location of the conductor or conductors relative to the shield thus remain substantially unchanged.

An exemplary permanently-coiled coaxial cable of the type shown in FIGS. 1 and 2 employs an inner conductor 12 having a diameter of 0.0031 inch and a primary dielectric insulation 14 having a diameter of 0.050 inch. Shield wire of 0.002 inch diameter forms an inner shield layer 16 having an outer diameter of 0.055 inch, and an outer shield layer 18 having an outer diameter of 0.060 inch. Each shield layer contains 56 strands of wire, although neither the same number nor the same size of wires in the respective layers is required. The outer diameter of a polyurethane jacket 20 is 0.120 inch. The jacket is held at its plasticizing temperature for approximately three hours and then cooled to form the permanent helical configuration.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A yieldably extensible, self-retracting cable comprising:

(a) a flexible electrical conductor;

(b) a flexible primary dielectric material surrounding said conductor, said dielectric material having a dielectric constant suitable for high frequency signal transmission and having a predetermined degradation temperature above which its electrical insulating capability is significantly decreased;

(c) a flexible wire shield surrounding said primary dielectric material, said shield comprising at least a pair of concentric layers of electrically-conductive wire wound helically in mutually-opposite directions, one layer being exterior of the other; and (d) a dielectric jacket surrounding said wire shield, said dielectric jacket comprising a heat-settable elastomeric dielectric material permanently formed in a yield ably extensible helical shape which likewise forms said conductor, said primary dielectric material, and said wire shield in a yieldably extensible helical shape, said elastomeric dielectric material of said jacket having a setting temperature which is less than said degradation temperature of said primary dielectric material.

2. The cable of claim 1 wherein said primary dielectric material is selected from the group consisting of polymeric fluorocarbon, irradiated polyethylene, and mixtures thereof.

3. The cable of claim 1 wherein said pair of concentric layers of electrically-conductive wire in said shield have substantially the same current-carrying capacities.

4. The cable of claim 1 wherein said wire shield is substantially free of any braided wire.

5. The cable of claim 1 wherein said primary dielectric material, shield and jacket have annular circular cross sections concentrically surrounding said conductor.

* * * * *

UNITED STATES PATENT AND TRADEMARK OFFICE

CERTIFICATE OF CORRECTION

PATENT NO. : 4,861,945

DATED : August 29, 1989

INVENTOR(S) : Arthur G. Buck et al.

It is certified that error appears in the above-identified patent and that said Letters Patent is hereby corrected as shown below:

Col. 4, line 31 Change "yield ably" to --yieldably--.

Signed and Sealed this

Fifth Day of November, 1991

*Attest:*

HARRY F. MANBECK, JR.

*Attesting Officer*

*Commissioner of Patents and Trademarks*